US005183160A

United States Patent [19]

McClain

[11] Patent Number: 5,183,160

[45] Date of Patent: Feb. 2, 1993

[54] HIGH VOLUME PADDING MACHINE

[76] Inventor: Ray McClain, 20152 E. 2nd, Tulsa, Okla. 74108

[21] Appl. No.: 605,225

[22] Filed: Oct. 24, 1990

[51] Int. Cl.[5] ..... B07B 9/00

[52] U.S. Cl. ..... 209/234; 37/142.5; 209/240; 209/257; 209/317; 209/420; 405/179

[58] Field of Search ..... 209/234, 240, 244, 255, 209/257, 315, 317, 413, 420, 935; 37/142.5; 405/179; 280/418.1, 289, 290; 305/15

[56] References Cited

U.S. PATENT DOCUMENTS

| | | | |
|---|---|---|---|
| 2,125,007 | 7/1938 | Ossing | 198/311 X |
| 3,624,784 | 11/1971 | Larson et al. | 280/418.1 X |
| 4,031,976 | 6/1977 | Lambert | 280/418.1 X |
| 4,363,725 | 12/1982 | Morita et al. | 209/257 |
| 4,616,957 | 10/1986 | Burrows et al. | 37/142.5 X |
| 4,664,791 | 5/1987 | McClain | 209/421 |
| 4,861,461 | 8/1989 | Utterback | 209/234 |
| 4,923,597 | 5/1990 | Anderson et al. | 209/315 X |
| 4,983,280 | 1/1991 | Eriksson | 209/257 X |
| 4,998,625 | 3/1991 | Read | 209/234 |

FOREIGN PATENT DOCUMENTS

| | | | |
|---|---|---|---|
| 1256474 | 6/1989 | Canada | 305/15 |
| 0088373 | 3/1990 | Japan | 305/15 |

*Primary Examiner*—Andres Kashnikow
*Assistant Examiner*—Joseph A. Kaufman
*Attorney, Agent, or Firm*—Head & Johnson

[57] ABSTRACT

A pipeline padding machine for use with a motorized carrier is mounted on a flat bed trailer adapted to be hitched to the carrier. Collector apparatus mounted beneath the screening apparatus receives the earth from a discharge at the bottom of the screening apparatus and conveys it to its discharge end which is located laterally of the carrier-trailer when the screening apparatus is in a transverse operational mode. A delivery apparatus pivotally mounted at a receiving end beneath the discharge end of the collector apparatus may in turn receive the earth discharged for delivery at greater distances from the screening apparatus. This delivery apparatus may be supported at its discharge end from the carrier or the trailer so that its discharge end may be located laterally of the carrier-trailer at a selected distance from the carrier-trailer within a variable range of distances. The screening apparatus preferably has two transverse operational modes so that undesirable objects and materials may be discharged to either side of the carrier-trailer depending on the mode selected. The collector apparatus is preferably reversible, so that relatively fine materials may be optionally discharged to either the same or the opposite side of the machine as the undesirable materials and objects. The delivery apparatus preferably is pivotally connectable beneath either end of the collector apparatus so that fine materials can be delivered to distant points from either side of the padding machine in either transverse operational mode and regardless of the direction of the collector apparatus.

4 Claims, 9 Drawing Sheets

HIGH VOLUME PADDING MACHINE

BACKGROUND OF THE INVENTION

This invention relates generally to pipeline padding machines and more particularly concerns padding machines which remove stones and other debris from excavated earth and return relatively clean soil into the excavation around a pipeline.

Most pipeline padding machines are laterally cantilevered from a tractor or other carrier with the padding machine positioned over the excavation or ditch containing the pipeline to be covered. As the tractor travels substantially parallel to the ditch, the padding machine traverses the length of the ditch and pipeline. This type of padding machine has many disadvantages.

One disadvantage is the limited size of the padding machine due to the cantilevered mounting arrangement. Reduced size results in reduced volume capability because volume is primarily a function of the surface area of the screen apparatus used to sift the earth. This disadvantage can be somewhat mitigated by the use of several tiers of vibrating screens, but this solution also increases the vertical profile of the machine which is itself undesirable. For example, some cantilevered padding machines discharge material from ten or more feet above the coated pipeline and the gravity accelerated velocity of the material from this height can damage the coating on the pipe.

The positioning of the padding machine over the ditch and adjacent to the carrier during the padding process is another disadvantage of the cantilever arrangement. In this relationship, heavy material is frequently deposited on top of the pipeline before it is sufficiently covered with fine material to protect the pipe. Therefore, the pipe may be damaged during the padding process.

The cantilevered arrangement also requires a clear pathway for the carrier parallel to and very close to the ditch to be filled. This is very impractical in difficult terrain conditions in which natural obstacles and variations in grade often obstruct the path of the carrier.

Feeding excavated earth into a cantilevered padding machine also presents a problem. Since the padding machine is over the ditch and directly adjacent to the carrier, access to the perimeter of the hopper which feeds excavated earth to the vibrating screen of the padding machine is quite limited. Any delay in the feeding process translates into a further reduction of the volume of clean earth returned to the ditch by the machine.

Another disadvantage of the cantilevered padding machine which emanates from its size limitations in conjunction with its location over the ditch is the inability of the unit to dispose of heavy materials not returned to the ditch at a distance far enough from the ditch so as not to interfere with padding or other work proximate the ditch. Furthermore, since the carrier is adjacent to the padding machine, it is extremely difficult to dispose of heavy materials anywhere other than along the edge of the ditch opposite the carrier.

One attempt to resolve some of these difficulties uses a towed padding machine which travels alongside of the ditch in a suspended arrangement beneath a rolling frame. This arrangement introduces many new problems. The mechanics and costs of suspending the enormous weight of the padding equipment beneath the frame limits the size of the machine and the surface area of the screen and therefore the volume of earth deliverable to the ditch. To conserve some space, the hopper which feeds the padding machine is mounted externally of the suspension structure, requiring another conveyor to transfer material from the hopper to the screen. Furthermore, since the hopper is external to the support structure and the machine, it can only be fed from one side.

Another type of padding machine is self-propelled and self-loading. As it travels, it plows up earth in front of it and conveys it upwardly and rearwardly to the padding equipment. This machine can only operate if moving in a forward direction and, typically, requires several passes along a given section of ditch to deliver sufficient material to pad a pipeline.

Accordingly, it is an object of this invention to provide a padding machine which is not cantilevered from its carrier. Another object of this invention is to provide a padding machine capable of distributing a high volume of padding material. And it is an object of this invention to provide a padding machine with a low velocity delivery system. A further object of this invention is to provide a padding machine which will deliver fine padding materials to a pipeline at a significantly greater distance ahead of the delivery point of relatively heavy padding materials than has been heretofore possible. It is also an object of this invention to provide a padding machine which facilitates the disposal of heavier materials either into the ditch, adjacent to the ditch or at distances from the ditch greater than heretofore possible. A related object of this invention is to provide a padding machine that will permit the padding machine and its carrier to operate at greater distances from the ditch than heretofore possible. A further object of this invention to provide a padding machine capable of traversing difficult terrain without interruption of the padding process. And it is an object of this invention is to provide a padding machine that can be used to stockpile fine materials.

SUMMARY OF THE INVENTION

In accordance with the invention, a pipeline padding machine is provided for use with a motorized carrier and a flat bed trailer adapted to be hitched to the carrier. Apparatus significantly longer than the width of the trailer for screening undesirable materials and objects from excavated earth is mounted on and selectively rotatable in relation to the trailer to either a fixed longitudinal transport mode or at least one fixed transverse operational mode. Collector apparatus mounted beneath the screening apparatus receives the earth from a discharge at the bottom of the screening apparatus and conveys it to its discharge end which is located laterally of the carrier-trailer when the screening apparatus is in one of its transverse operational modes. In addition, a delivery apparatus pivotally mounted at a receiving end beneath the discharge end of the collector apparatus may be used to receive the earth discharged and deliver it to its more distant discharge end. This delivery apparatus may be supported at its discharge end from the carrier or the trailer so that its discharge end may be shifted laterally of the carrier-trailer at a selected distance from the carrier-trailer within a variable range of distances. A tilting apparatus may also be employed to maintain the screening apparatus in a horizontal attitude as the padding machine traverses inclines or declines in the terrain. The screening apparatus preferably has two opposite transverse operational modes so that undesirable materials and objects may be discharged to either side of the carrier-trailer depending on the mode selected. The collector apparatus is preferably reversible, so that relatively fine materials may be optionally discharged to either the same or the opposite side of the machine as the undesirable materials and objects. The delivery apparatus preferably is pivotally connectable beneath either end of the collector apparatus so that fine materials can be delivered to distant points from either side of the padding machine in either transverse operational mode and regardless of the direction of the collector apparatus.

BRIEF DESCRIPTION OF THE DRAWINGS

Other objects and advantages of the invention will become apparent upon reading the following detailed description and upon reference to the drawings in which.

Figure 1:
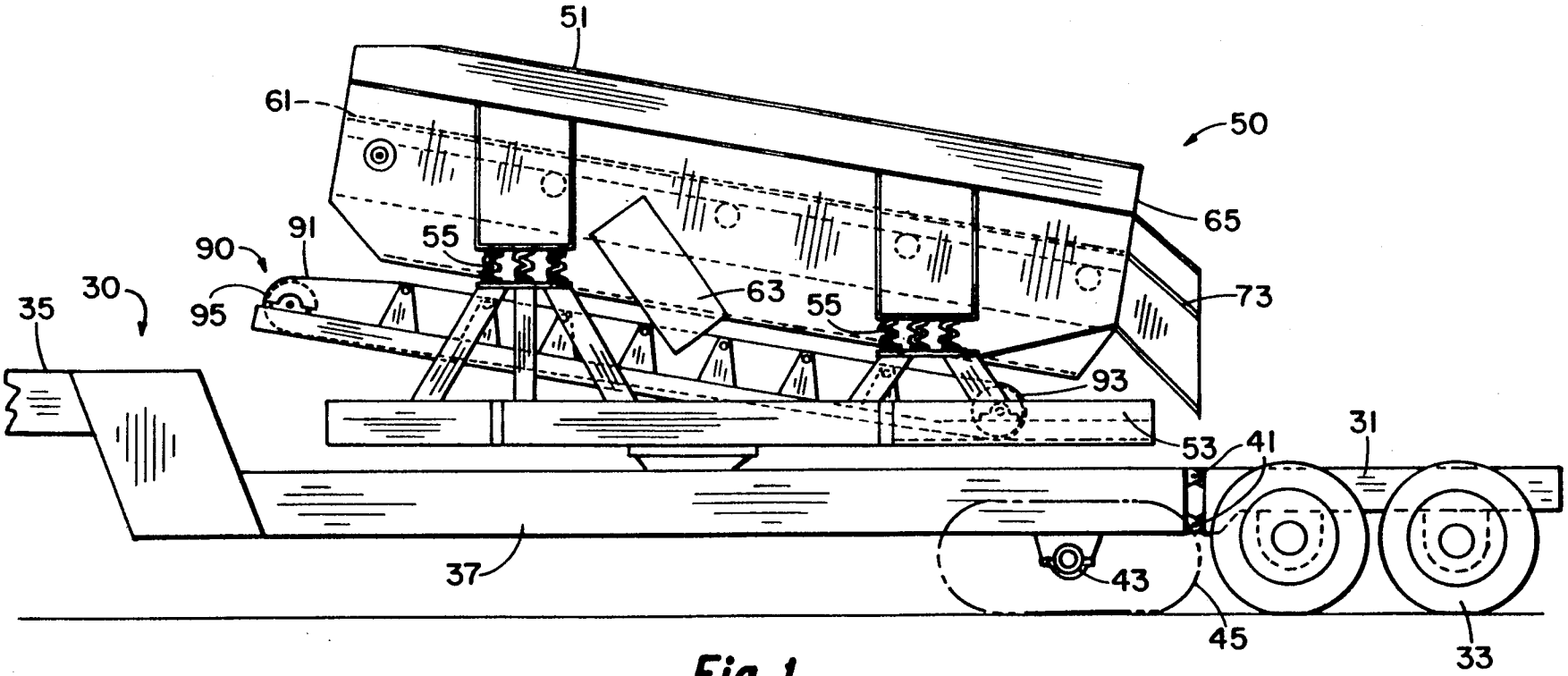
FIG. 1 is a side elevational view of a preferred embodiment of the padding machine mounted on a flat bed trailer in a longitudinal transport mode for travel on the highway.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

The pipeline padding equipment contemplated by the present invention includes a motorized carrier 10, a flatbed trailer 30, an earth screening apparatus 50, a collector apparatus 90, a delivery apparatus 110, a supporting apparatus 130 and a tilting apparatus 150. These apparata are designed to be relatively easily assembled to or dismantled from one another, depending on whether the padding equipment is to be in an operational mode or a transport mode.

FIGS. 1 through 4 illustrate some of these apparata in their dismantled or transport mode generally used for highway travel. The embodiment shown, arranged for transport, includes a flatbed trailer 30 having a rear end 31 mounted on and supported by wheels 33. The front end 35 of the trailer 30 is adapted to be connected to a tractor-cab (not shown) for highway towing. The trailer bed 37 has disposed in its central portion a downwardly and inwardly tapered seat 39, as can best be seen in FIG. 7. In the preferred embodiment shown, the seat 39 has the shape of an inverted truncated cone. However, for reasons that will hereinafter become apparent, any inverted, truncated configuration could be employed so long as it is symmetrical about 90° axes of the trailer 30, also for reasons that will hereinafter become apparent. As shown, the rear portion 31 of the trailer 30 and the wheels 33 are disconnectable from the trailer 30 at pin junctions 41. In addition, the trailer 30 is fitted with mounts 43 so that the trailer 30 may be alternatively supported on tracks 45 (shown in phantom) rather than on wheels 33.

Figure 2:
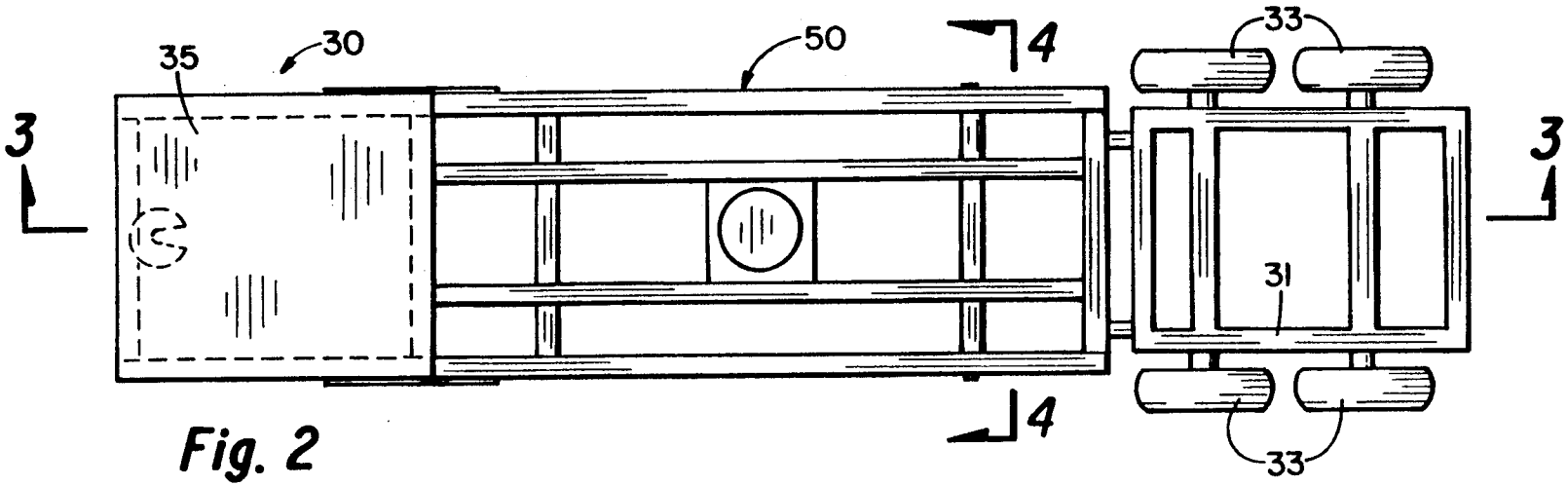
FIG. 2 is a plan view of the padding machine and trailer of FIG. 1.
Figure 4:
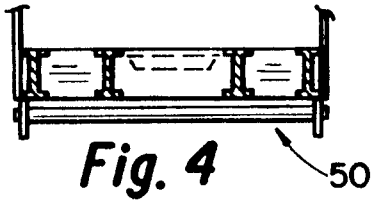
FIG. 4 is a cross-sectional view taken along line 4—4 of FIG. 2.
Figure 3:
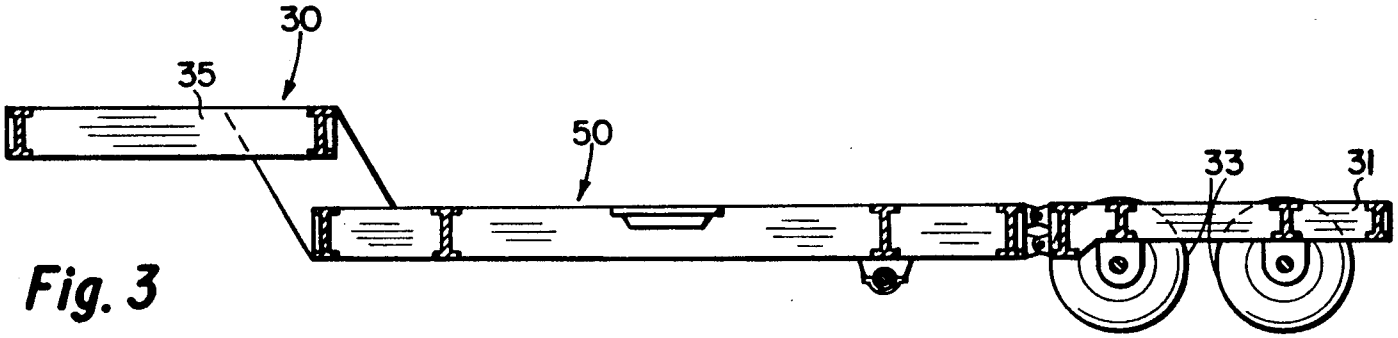
FIG. 3 is a cross-sectional view taken along line 3—3 of FIG. 2.

In the travel mode shown in FIGS. 1 and 2, the earth screening apparatus 50 and the collector apparatus 90 are mounted on the flatbed trailer 30. The remaining apparata are dismantled for transportation purposes and not shown in these Figures. The earth screening apparatus 50 consists of a hopper 51 substantially longer than the width of the trailer bed 30, preferably at least two times its width. The width of the hopper 51 substantially coincides with the width of the trailer 30. Thus, with the screening apparatus 50 in the longitudinal transport mode shown, highway travel restrictions due to the width of the load are held to a minimum. As shown, the screening apparatus 50 also includes a frame 53 to which the hopper 51 is connected by isolation springs 55 with the hopper 51 preferably in a tilted or inclined condition along its longitudinal axis. The frame 53 is in turn mounted on a bearing 57 which, as shown, rotates atop a support 59 in the form of an inverted truncated cone complementary to the inverted truncated con of the seat 39 in the trailer bed 30. The bearing support 59 need not necessarily be a truncated cone, but always complements the configuration of the trailer seat 39 as hereinbefore described. Removable pins may be used to fix the frame 53 in the desired longitudinal or transverse mode on the trailer 30.

Figure 5:
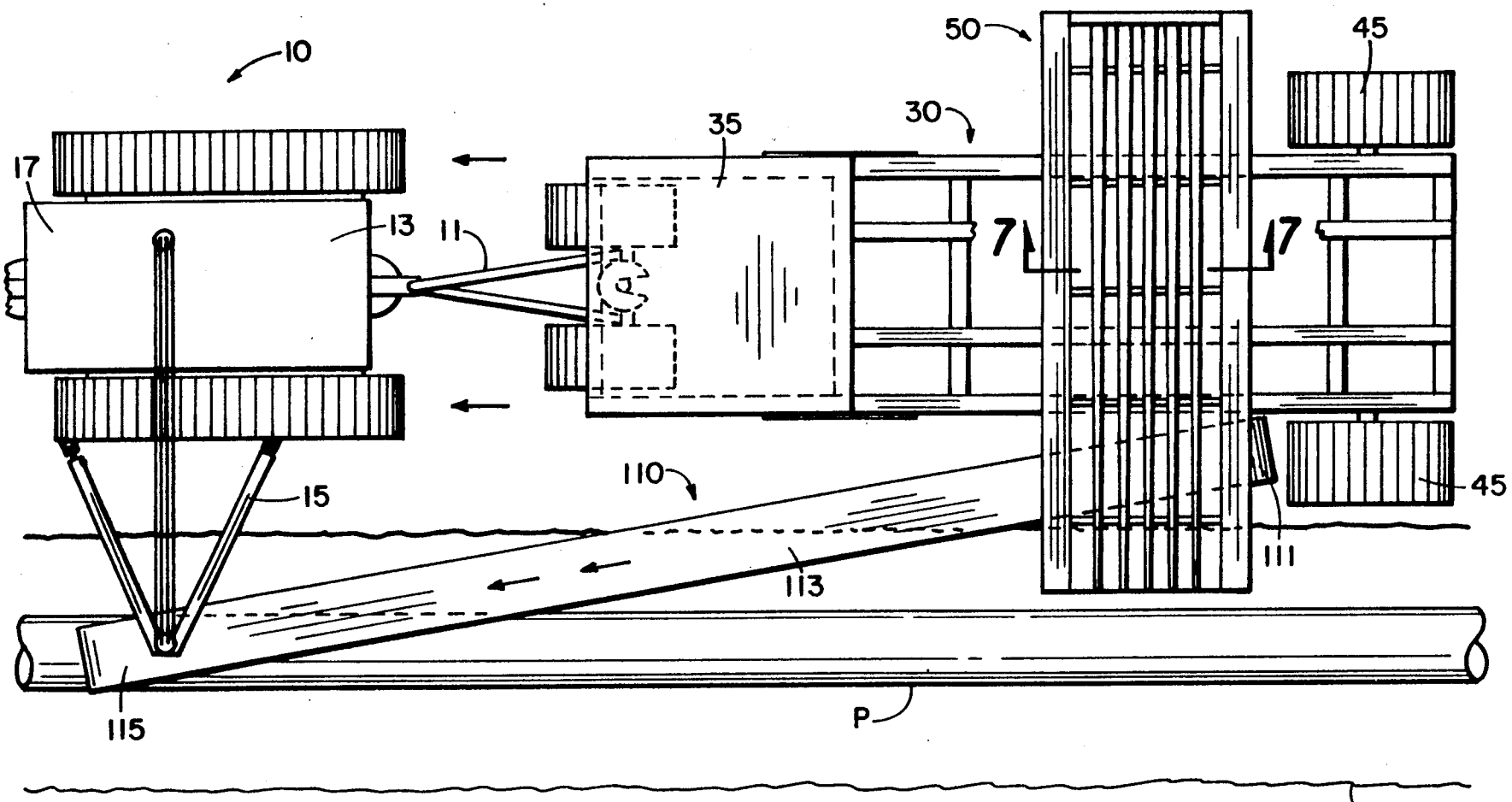
FIG. 5 is a plan view of a preferred embodiment of the padding machine, trailer and tractor with the screening apparatus in a transverse operational mode for travel along a ditch.

In FIG. 5, the padding equipment is illustrated in a transverse operational mode at a site where a pipeline P is to be buried in a ditch D. With the tractor-cab (not shown) disconnected from the front end 35 of the trailer bed 30, the trailer 30 may be connected by a hitching apparatus 11 to a motorized carrier 10, preferably but not necessarily a side boom tractor as shown. For example, a motorized crane might serve as well. As shown in FIG. 5, the rear 13 of the motorized carrier 10 is hitched to the trailer 30 so that, as the motorized carrier 10 moves in a forward direction, it will tow the trailer 30 with its boom 15 extending laterally to one side of the motorized carrier 10. However, the front end 17 of the motorized carrier 10 is similarly adapted so that the trailer 30 may be hitched to the front end 17 of the motorized carrier 10, enabling the trailer 30 to be towed with the motorized carrier 10 proceeding in a backward direction, and the boom 15 extending on the opposite side of the trailer 30 in relation to its direction of travel when moving in a forward direction, all for reasons to be hereinafter discussed. As shown in FIG. 5, tracks 45 are mounted on the trailer mounts 43 and the rear portion 31 of the trailer 30 on which the transport wheels 33 are mounted is disconnected from the main portion of the trailer 30 by the disconnection of the pin junctions 41.

Figure 6:
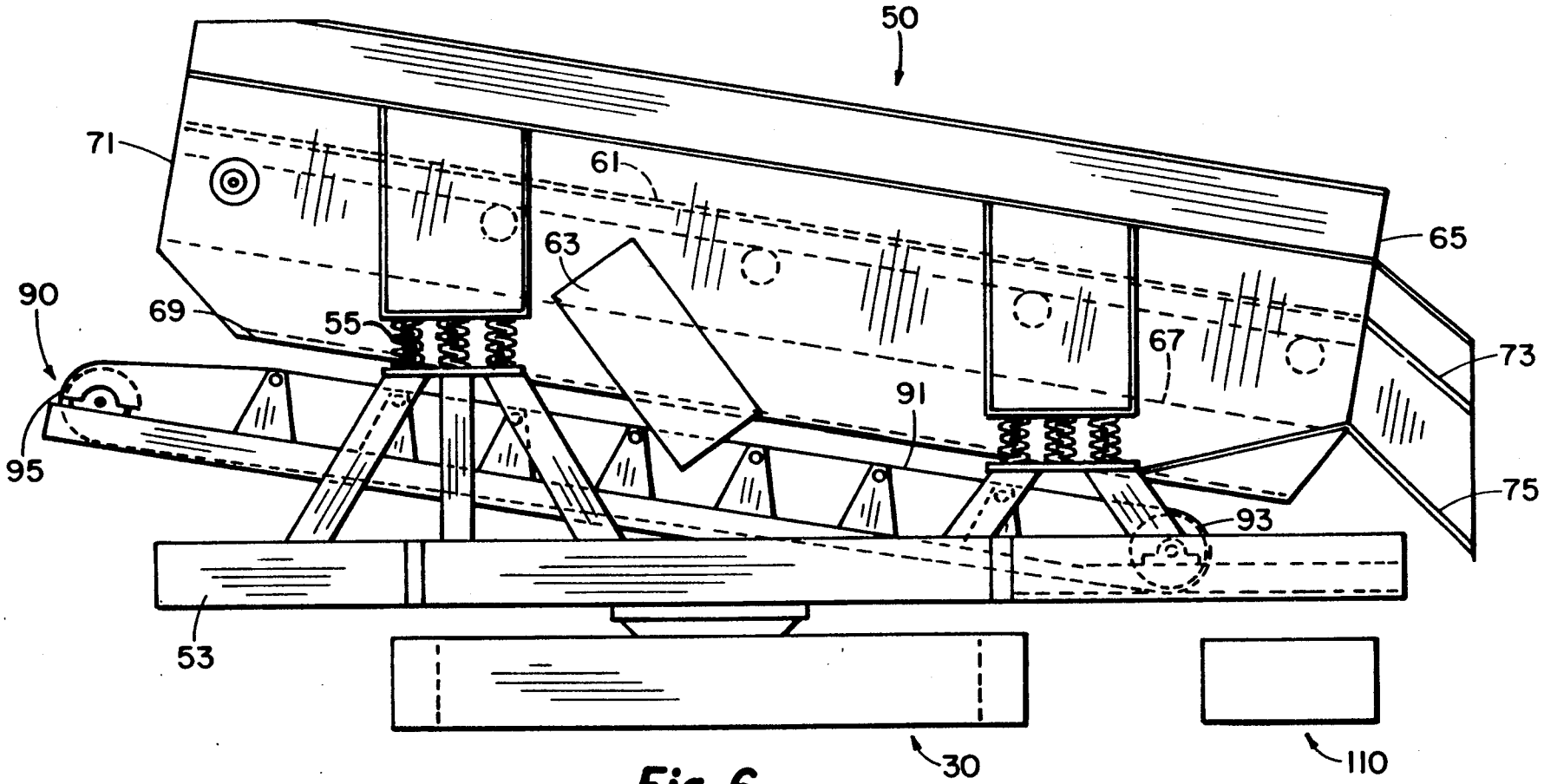
FIG. 6 is a side elevational view of a preferred embodiment of the padding machine and trailer shown in FIG. 5.

When the equipment is to be used to pad a pipeline P, the screening apparatus 50 is rotated out of the transport mode and into an operational mode in which the screening apparatus 50 is transverse to the longitudinal axis or direction of movement of the carrier-trailer. This is accomplished by rotating the screening apparatus 50 on its bearing 57 90° in relation to the trailer bed 30. With the screening apparatus 50 in its desired operational mode, the delivery apparatus 110, if it is to be used, is pivotally connected at its receiving end 111 beneath the discharge end 93 of the collector apparatus 90 and suspended at its discharge end 113 from the motorized carrier boom 15 as shown or in similar fashion from the trailer 30, as will hereinafter be explained in greater detail. However, it should be observed at this point by reference to FIG. 5 that, with the motorized carrier 10 moving in a forward towing direction and with the screening apparatus 50 rotated to a first selected operational mode as shown in FIG. 6, the carrier-trailer combination can operate on one side of the ditch D with the capability of delivering earth into the ditch D a considerable distance in advance of the screening apparatus 50 and a distance from the ditch D variable by the operation of the boom 15 of the motorized carrier 10 or trailer 30. Alternatively, with the motorized carrier 10 moving in a reverse direction as it tows the trailer 30 and with the screening means 50 rotated into a second operational mode 180° opposite to the first operational mode, the carrier-trailer combination can pad the pipeline P from the opposite side of the ditch D.

Figure 7:
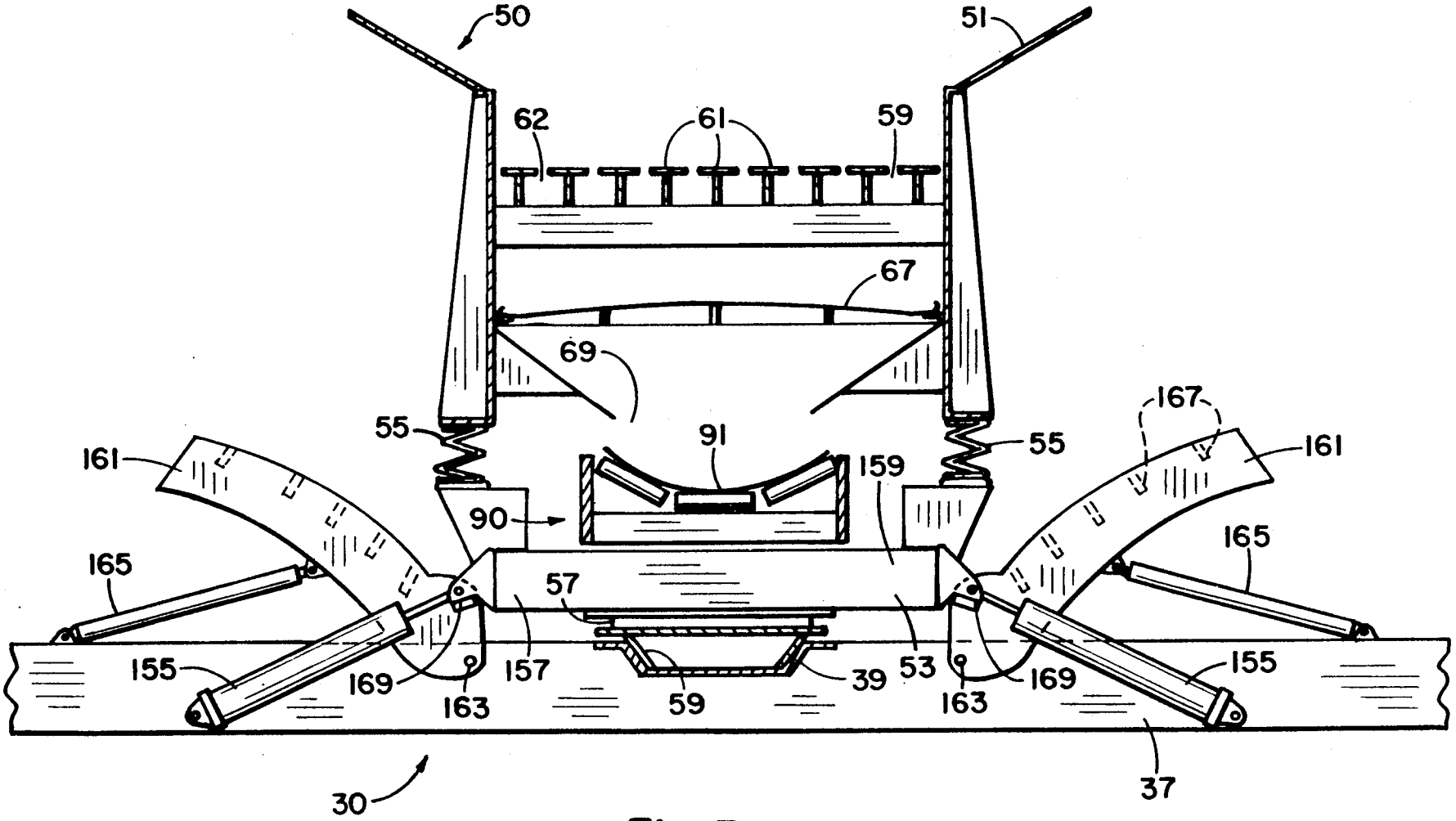
FIG. 7 is a cross-sectional view taken along line 7—7 of FIG. 5.

Looking at FIGS. 6 and 7, the interrelationships of the screening apparatus 50, the collector apparatus 90 and the delivery apparatus 110 can be more clearly understood. As shown in FIG. 6, the screening apparatus 50 has been rotated to a first transverse or operational mode in relation to the longitudinal axis of the trailer 30. FIG. 7 best illustrates the constituent parts of the screening apparatus 50. It includes a hopper 51 into which may be fed earth containing stones, debris and other materials of a size unsuitable for use in padding the pipe P. In order to provide relatively clean earth to the pipeline P, the earth preferably first passes through a mechanism designed to remove relatively large stones, debris and the like from the earth. This first mechanism may preferably consist of an arrangement of grizzly bars 61 spaced at desired intervals 63 to pass most of the earth but prevent the larger undesirable materials from passing therethrough. A wide mesh screen (not shown) could also be used. The screening apparatus 50 is vibrated by one or more vibrating motors 63. Since the hopper 51 and the grizzly bars 61 are part of the screening apparatus 50, the heavy materials removed will gradually move to one end of the screening apparatus 50 as the screening apparatus 50 vibrates. This movement can be hastened by increasing the spacing 62 between the bars 61 in the direction of vibration of the screening apparatus 50 and also by stepping the level of or tilting the grizzly bars 61 downwardly toward the discharge end 65 of the screening apparatus 50. With the large stones and material removed, the earth passed through the grizzly bars 61 is preferably fed to a second mechanism intended to remove medium size stones, debris and other materials from the earth. As shown, this second mechanism is a screen 67 also vibrated with and having a mesh smaller than the grizzly bar spacing 62 or mesh above it. Since this screen 67 is also vibrated with the screening apparatus in the same direction as the grizzly bars 61, the medium sized materials collected by it will move toward the discharge end 65 of the hopper 51 as did the larger materials. The movement of materials to the discharge end 65 of the hopper 51 is facilitated by the reciprocable motion of the screen apparatus 50. The motor 63 provides a component of motion toward the discharge end 65 which may be further enhanced by angling the mechanism to take advantage of gravity. As the medium size stones, debris and other material are sifted from the earth by the screen 67, the relatively clean earth passes through the screen 67 to a discharge port 69 in the bottom of the hopper 51 which extends along the hopper's length and tapers inwardly and downwardly. Clean earth is thus directed through the discharge port 69 to the collector apparatus 90 mounted on the screening apparatus frame 53 and extending for the length of the hopper 51 beneath the discharge port 69. It should be noted that the padding machine may incorporate either one or both of the undesirable material and object removal mechanisms.

The collector apparatus 90 as shown includes a roller mounted continuous conveyor belt 91, motor driven in either forward or reverse direction at the option of the operator, so that either end of the collector apparatus 90 may serve as the discharge end for the earth collected from the discharge port 69 of the screening apparatus 50. Thus, it will be seen that the relatively fine or clean materials collected by the collector apparatus 90 may be discharged either toward the same end 65 of the hopper 51 to which the large and medium size materials are directed or to the opposite end 71 of the hopper 51 in relation to the larger and medium sized materials. As shown in FIG. 6, the discharge end 93 of the collector apparatus is at the low or discharge end 65 of the screening apparatus 50. It should be noted that, when the collector apparatus 90 is operated in a forward direction to discharge fine materials at its low end 93, the discharge end 93 of the collector apparatus 90 is beneath the screening apparatus 50 and above the receiving end 111 of the delivery conveyor 110. The hopper 51 is equipped with discharge chutes 73 and 75 for the large and the medium size materials, respectively, which extend beyond the discharge end 93 of the collector conveyor 91 and the receiving end 111 of the delivery conveyor 110 so that these materials will not be discharged onto the delivery conveyor 110 where only fine materials are to be received. Alternatively, the delivery conveyor 110 may be connected beneath the other or high end 95 of the collector conveyor 91 to receive fine materials when the collector conveyor 91 is operated in the reverse direction. Thus, as fine materials are delivered from the high end 95 of the collector conveyor 91, large and medium sized materials are being discharged on the opposite end 65 of the screening apparatus 50.

Figure 8:
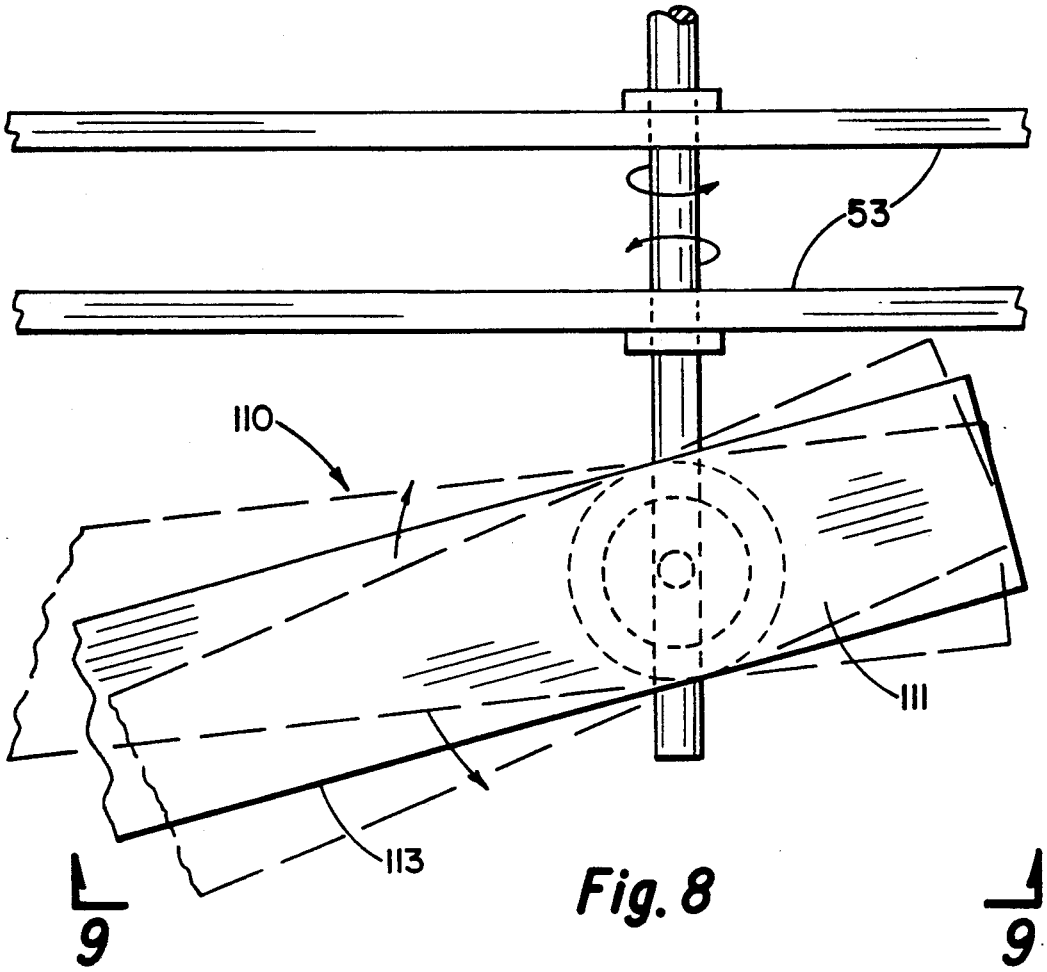
FIG. 8 is a top view of a preferred embodiment of the pivotal connection of the delivery apparatus of the padding machine.
Figure 9:
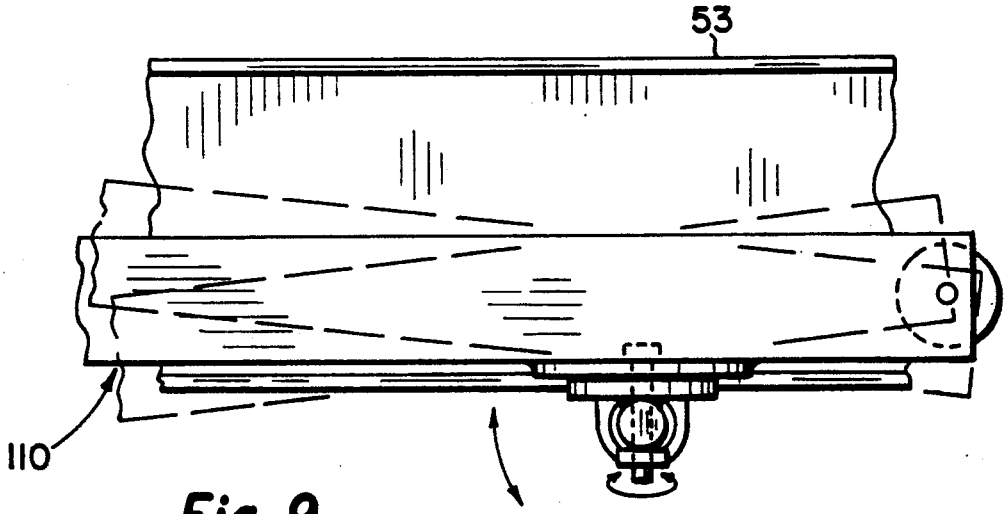
FIG. 9 is a side elevational view of the pivotal connection of FIG. 8.

The delivery conveyor 110 illustrated in FIG. 5 consists of a roller mounted continuous conveyor belt 113 motor driven to deliver fine materials discharged from either discharge end 93 or 95 of the collector apparatus 90 to a point to the side of the carrier-trailer and forward of the discharge end 93 or 95 of the collector apparatus 90. The receiving end 111 of the delivery apparatus 110 is mounted in a pivoting arrangement beneath the discharge end 93 or 95 of the collector apparatus 90. It may be connected to the screening apparatus frame 53 as shown in FIGS. 8 and 9 or in similar fashion to the trailer 30. A similar pivot mounting is provided beneath both ends 93 and 95 of the collector apparatus 90 so that, when it operates in reverse and the high end 95 becomes the discharge end of the collector apparatus 90, the delivery conveyor 110 can be connected to receive the fine materials discharged from this side of the collector apparatus 90.

Figure 10:
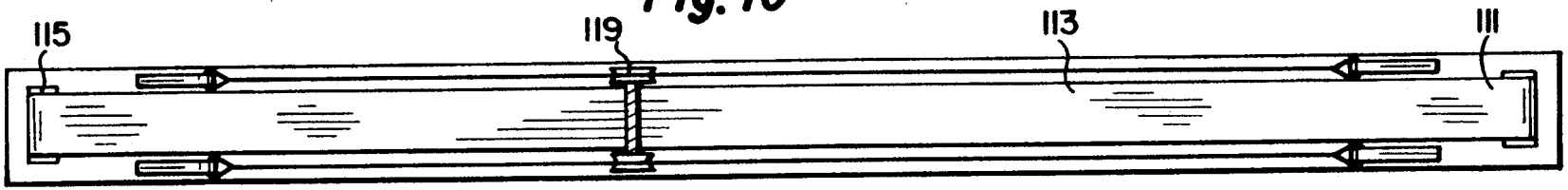
FIG. 10 is a top view of a preferred embodiment of the support apparatus for the delivery conveyor.
Figure 11:
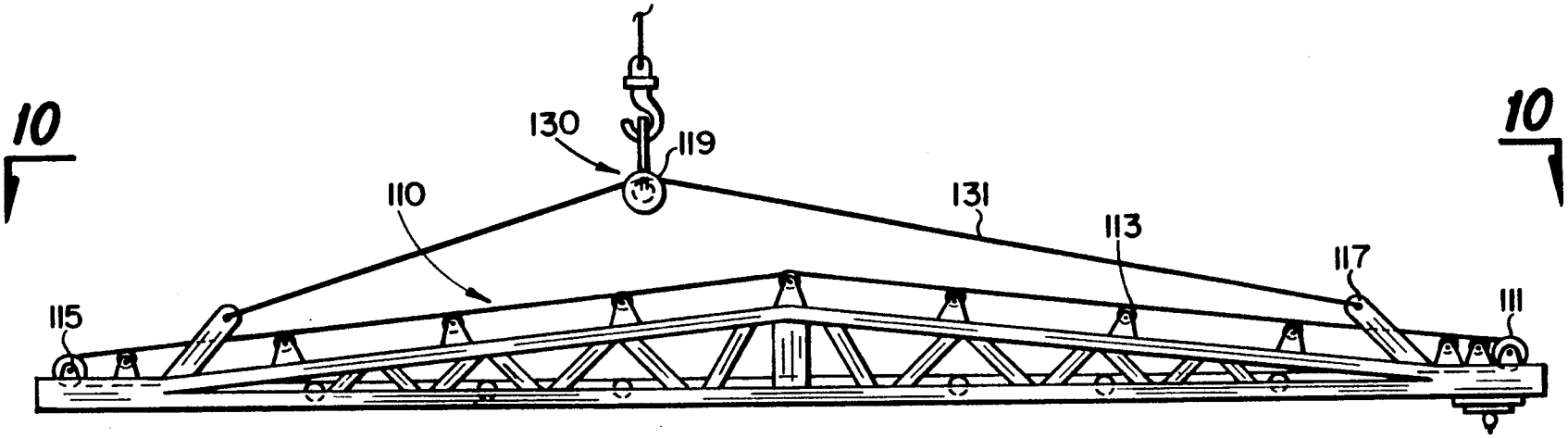
FIG. 11 is a side elevational view of the support apparatus of FIG. 10.

The forward or discharge end 115 of the delivery apparatus 110 is connected by the supporting apparatus 130 to the boom 15 of the motorized carrier 10. As shown in FIGS. 10 and 11 , cables 131 extending from the discharge end 115 of the delivery apparatus 110 to a point 117 more proximate the receiving end 111 of the delivery apparatus 110 are mounted across a pulley arrangement 119 which is in turn suspended from the boom 15. Thus, as the boom 15 is raised or lowered, the discharge end 115 of the delivery apparatus 110 will swing closer to or further from the carrier or trailer as the delivery apparatus 110 rotates about the pivot mounting at its receiving end 111. It will be noted that the delivery apparatus 110 can be of such a length as to extend considerably forward of the motorized carrier 10. In practice, it has been found that this arrangement can be used to provide fine materials for padding the pipe P at the discharge end 115 of the delivery apparatus 110 at distances ranging up to approximately 60 feet forward of the high and medium sized material discharge chutes 73 and 75 of the screening apparatus 50.

Figure 12:
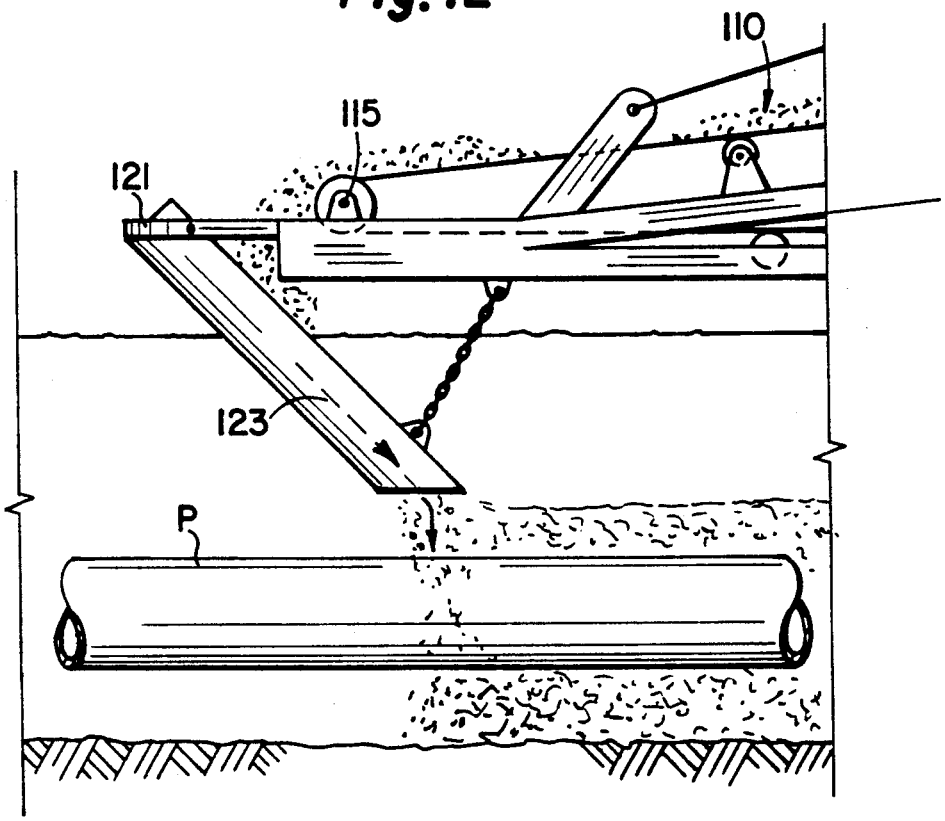
FIG. 12 is a side elevational view of a preferred embodiment of the decelerator.

In a particularly preferred embodiment, the delivery apparatus 110 also includes a decelerator 119, as shown in FIG. 12, to reduce the velocity of the fine materials at impact with the pipe P. The decelerator 119 consists of a deflector 121 located forward of the discharge end 115 of the delivery conveyor 110 to block the forward motion of the fine materials and cause them to gravitate downwardly onto a fixed belt 123 which is angled downwardly and rearwardly from the deflector 121 to delay discharge the finer materials to the full force of gravity to a point as close to the pipe P as possible.

Figure 13:
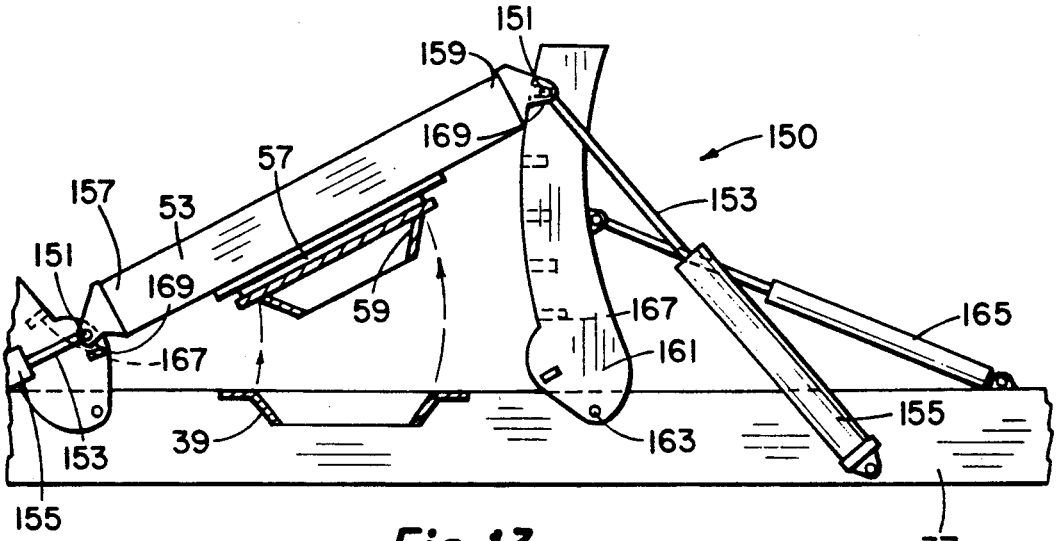
FIG. 13 is a side elevational view of a preferred embodiment of the tilting apparatus.
Figure 14:
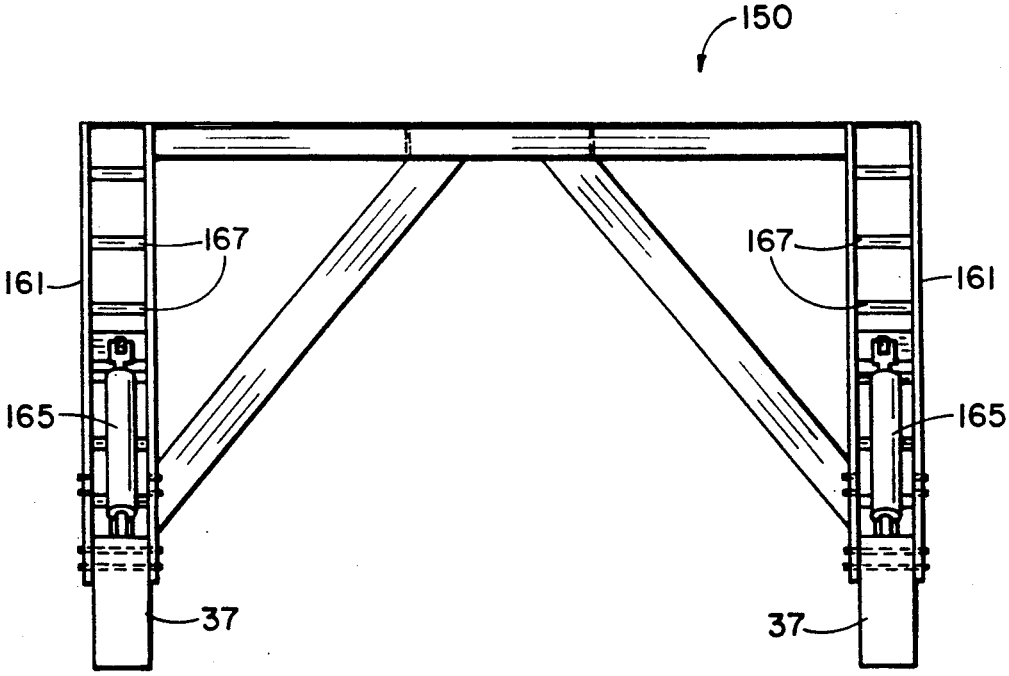
FIG. 14 is a plan view of the tilting apparatus of FIG. 13.

In many applications involving hilly terrain, the longitudinal axis of the trailer bed may vary considerably in relation to horizontal. With the screening apparatus 50 in one of its transverse operational modes, the attitude of the trailer bed 30 is imposed upon the screening apparatus 50 and the collector apparatus 90. In order to insure maximum efficiency of the padding machine, apparatus for tilting the frame 53 on which the screening and collector apparata 50 and 90 are mounted is provided, as illustrated in FIGS. 7, 13 and 14. The support frame 53 of the screening apparatus 50 is provided with removable pin connections 151 which each may be connected to the shaft 153 of pistons mounted in hydraulic cylinders 155 pinned to the trailer bed 37. One of these hydraulic arrangements is connected on the forward side 157 of the frame 53 and one on the rear side 159 of the frame 53 when the frame 53 is in one of the transverse operational modes. Thus, it will readily be seen, that the hydraulic system associated with the cylinders 155 may be activated to selectively raise either the forward 157 or rear side 159 of the frame 53, thus tilting the entire screening apparatus 50. The tilting apparatus 150 further includes four legs 161 connected by removable pins 163 to the trailer bed 37 with one pair of legs 161 pinnable beneath the screening apparatus 50 on each side of the trailer bed 37 so that each pair of legs 161 can pivot about its pins 163 toward the forward 157 or rear 159 side of the screening apparatus frame 53. Each pair of legs 161 is separately connected to the trailer bed 37 by one of a second set of hydraulic piston-cylinder arrangements 165, preferably located proximate the center line of the trailer 30, so that a selected pair of legs 161 can be rotated toward or away from the vertical position by operation of the appropriate hydraulic arrangement 165. In some applications, it may be desirable to replace the hydraulic systems 155 and 165 with pneumatic systems.

As shown in this preferred embodiment, the legs 161 are slightly arced and have a plurality of shelves 167 disposed along their inward edges proximate the screening apparatus frame 53. The shelves 167 receive a mating portion 169 of the screening apparatus frame 53 so as to support the screening apparatus frame 53 in its desired tilted position. It should be noted that, in the preferred embodiment, the shelves 167 are disposed at least a three degree angle downwardly from the horizontal at the point where they engage with the mating portion 169 so that the mating portion 169 of the frame 53 can be firmly seated on the shelf 167. In operation, when hilly terrain is encountered, the appropriate tilting hydraulic system 155 is pinned in place so that the low side of the screening apparatus 50 can be raised to the horizontal position. Once so raised, the hydraulic system 165 of the appropriate supporting legs 161 is operated to rotate the legs 161 upwardly about their pins 163 on the trailer bed 37 until the appropriate shelf 167 on the legs 161 aligns with the mating portion 169 on the screening apparatus frame 53. When both legs 161 are so aligned, the frame hydraulic system 155 is released to fully seat the mating portion 169 of the frame 50 on the shelf 167. The screening apparatus 50 is now in its appropriate horizontal attitude for operation with the trailer bed 30 moving across the incline or decline of the terrain.

As previously noted, the machine herein disclosed is capable of delivering fine materials to a point up to approximately 60 feet in advance of the large and medium sized materials discharge chutes 73 and 75 of the screening apparatus 50. Furthermore, the location of the discharge end 115 of the delivery apparatus 110, using presently available motorized carriers 10 equipped with booms 15, may vary in the range of from five to thirty feet from the side of the carrier 10. It can be seen that the machine can be used to discharge the fine materials from the same side of the screening apparatus 50 as the large and medium sized materials are being discharged from or, at the choice of the operator, from the opposite side by rotating the screening apparatus 50 into the second operational mode. Furthermore, by reversing the direction of motion of the carrier 10 and the operational mode of the screening apparatus 50, the machine can be operated on either side of a ditch D, traveling in either direction. And, it should also be noted that by moving the path of the carrier 10 a greater distance from the ditch D and reversing the operation of the collector conveyor 91 to discharge fine materials on the opposite end 71 of the screening apparatus 50 from its medium size and large materials discharge chutes 73 and 75, discharging of these materials a relatively great distance from the ditch D is also possible.

The generator, control station, fuel tanks and hydraulic reservoirs (not shown) typically associated with padding machines may be mounted on the forward portion 35 of the trailer bed 30. Preferably, the vibrating hopper 51, grizzly bars 61 and screen 67 and the collector conveyor 91 will be sloped at a 7° to 8° angle in the longitudinal direction of the screening apparatus 50. However, not all of these elements need be sloped at the same angle and one or more of these elements may be horizontal or at an angle considerably greater than 7° to 8°.

In its longitudinal transport mode, the trailer bed 30, including the equipment mounted thereon, has a preferable maximum width of approximately ten feet for highway travel. In its fully assembled condition, the machine preferably weighs up to approximately 50,000 pounds, though significantly higher weights are possible. The overall vertical profile of the machine in the assembled condition preferably provides a two foot ground clearance below the discharge end 115 of the delivery apparatus 110 and a thirteen foot maximum height for the total assembly.

It should also be noted that the screening apparatus 50 can be fed from any direction without any work being done over bare pipe P because the pipe P will all have been padded a considerable distance in advance of the screening apparatus 50. And the transverse operational modes of the machine provide vibrating screen surface area two to three times that of the vibrating screens possible with presently known apparatus. Thus, this high volume, low velocity padding machine makes possible the padding of pipelines in one half to one third the time now presently required.

Thus, it is apparent that there has been provided, in accordance with the invention, a high volume, low velocity padding machine that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A padding machine to be towed behind a motorized carrier comprising:

transport means adapted to be hitched to said carrier;

seat means disposed on said transport means;

bearing means nestled in said seat means;

support means mounted on said bearing means above said transport means;

hopper means mounted on said support means having a bottom with a first discharge port therein;

separator means for catching relatively large stones and debris in earth fed into said hopper means and for passing separated materials therethrough;

sift means mounted in said hopper means beneath said separator means for catching relatively medium size stones and debris passing through said separator means and for passing sifted materials through said sift means and said first discharge port;

discharge means for distributing stones and debris caught by said sift means outwardly of said hopper means;

collection means mounted beneath said hopper means for receiving said sifted materials passing through said sift means and said first discharge port and for conveying said sifted materials outwardly in relation to said hopper means to a discharge end of said collection means; and delivery means for conveying said sifted materials from said discharge end of said collection means to a discharge end of said delivery means.

2. A padding machine according to claim 1 further comprising a suspension means adapted to extend from said carrier for supporting said discharge end of said delivery means laterally of said carrier at a variable range of distances.

3. A padding machine according to claim 1 further comprising a suspension means adapted to extend from said trailer for supporting said discharge end of said delivery means laterally of said trailer at a variable range of distances.

4. A padding machine to be towed behind a motorized carrier comprising:

an elongated transport means having a forward end adapted to be hitched to said carrier, a rear end supported above ground by a wheel means and a seat means therebetween;

an elongated support means spaced above said transport means by a bearing means nestled in said seat means;

an elongated hopper means mounted on said support means in an inclined relationship to said transport means and having a bottom with a discharge port;

an inclined collection means mounted on said support means beneath said hopper means and aligned with said discharge port;

separating means for catching relatively large stones and debris in earth fed into said hopper means and for passing remaining materials therethrough;

an inclined vibrating screen means mounted in said hopper means beneath said separating means for catching relatively medium size stones and debris passing through said separating means and for passing remaining materials through said screen means and through said discharge port onto said collection means;

a discharge means extending from said hopper means for distributing stones and debris caught by said screen means outwardly of said hopper means;

a delivery means for transporting said remaining materials passed through said screen means from a discharge end of said collection means to a point laterally and forwardly of said carrier; and a suspension means extending from said carrier for supporting said delivery means and for varying the location of said point along an arc about the discharge end of said collection means.

* * * * *